US005762033A

United States Patent [19]

Rembold et al.

[11] Patent Number: 5,762,033

[45] Date of Patent: Jun. 9, 1998

[54] INJECTION DEVICE FOR COMBINED INJECTION OF FUEL AND SUPPLEMENTARY FLUID OR LIQUID

[75] Inventors: Helmut Rembold, Stuttgart; Walter Teegen, Waiblingen, both of Germany

[73] Assignee: Robert Bosch GmbH, Stuttgart, Germany

[21] Appl. No.: 882,211

[22] Filed: Jun. 25, 1997

[30] Foreign Application Priority Data

Jun. 27, 1996 [DE] Germany ..... 196 25 698.4

[51] Int. Cl.[6] ..... F02B 47/02

[52] U.S. Cl. ..... 123/25 C; 123/25 R

[58] Field of Search ..... 123/25 R, 25 C

[56] References Cited

U.S. PATENT DOCUMENTS 5,529,024 6/1996 Wirbeleit et al. ..... 123/25 C
5,651,346 7/1997 Remmels ..... 123/25 C
5,669,334 9/1997 Schonfeld ..... 123/25 C
5,671,717 9/1997 Rembold et al. ..... 123/25 C

*Primary Examiner*—Erick R. Solis
*Attorney, Agent, or Firm*—Edwin E. Greigg; Ronald E. Greigg

[57] ABSTRACT

An injection device for a combined injection of a fuel and a supplementary liquid, into the combustion chamber of an internal combustion engine. In this device, the fuel is injected by means of an injection valve controlled by an electromagnetic valve, and the injection valve additionally has a connection to a supplementary liquid pressure source that is provided with an intermittent-supply piston driven by a controlled pressure medium. For the pressure medium, pressure is drawn from a pressure reservoir; the pressure is supplied by a high-pressure feed pump provided for creating high pressure for fuel to be injected.

20 Claims, 5 Drawing Sheets

INJECTION DEVICE FOR COMBINED INJECTION OF FUEL AND SUPPLEMENTARY FLUID OR LIQUID

BACKGROUND OF THE INVENTION

The invention is based on an injection device for the combined injection of fuel and a supplementary fluid or liquid, particularly water, into a combustion chamber of an internal combustion engine.

The combined injection of fuel and supplementary fluid or liquid, particularly water, serves to reduce the nitrogen oxide and particulate emissions, especially in self-igniting internal combustion engines.

In a known injection device of the generic type (German Patent DE 44 07 052 C1), high-pressure fuel injection is effected in diesel internal combustion engines by means of a fuel injection pump of series design, whose high-pressure capacity per pump-piston stroke can be changed by a known oblique-edge control. In this known injection device, the supply device for the supplementary liquid is reinforced by a partial supply stroke of the pump piston in that an expanded cam region is provided at the cam drive of the fuel injection pump that effects a new pump-piston drive following the primary injection, thus supplying fuel to the supply device by way of a 4/2-way magnet valve that has spring restoration. The pressure chamber of the fuel injection valve is supplied with a corresponding quantity of water by means of a supply piston acted upon by the pressure of this fuel; the water forces a corresponding quantity of fuel out of the pressure chamber and causes it to flow off via the 4/2-way magnet valve. At the same time, the supply piston is a dividing piston between the media of supplementary liquid and fuel of the high-pressure-drive side. The supply piston is actuated via a 3/2-way magnet valve in that the supply piston is acted upon by the supply pressure of the pump piston to supply the supplementary liquid, and communicates with a relief side for ending the feeding of the supplementary liquid.

OBJECT AND SUMMARY OF THE INVENTION

In contrast, the injection device of the invention has the advantage that the aforementioned complication with an additional cam is eliminated; that the metering of the quantity of fuel to be injected is significantly more universal, and can be controlled as a function of numerous parameters; and, further, that the metering of the supplementary liquid, which is likewise controlled by means of a magnet valve, can take into consideration a plurality of parameters. Because a high-pressure reservoir is provided, the injection pressure is available at a specified level at all times, and is delivered for injection, controlled exactly with respect to quantity and injection time, by the metering device, which has an electromagnetic valve.

In an advantageous modification, a further feature defined hereinafter for feeding supplementary liquid is no longer a function of the work cycles of an individual pump piston, as in the related art; instead, pre-storage for the necessary times can be effected in the fuel injection valve, by means of the electrically-controlled valve and the high fuel pressure that is always available.

It is particularly advantageous if the high-pressure reservoir serves as a source for the high fuel pressure that drives the supply piston of the supply device. In this instance, a pressure intensification takes place, because of the difference in area between the work surface and the supply surface, so that the supplementary liquid can be introduced into the pressure chamber of the fuel injection valve, even counter to high fuel pressure present in the injection valve.

In a modified form, a higher fuel pressure is made available for activating the supply piston of the supply device by the provision of an additional reservoir that is supplied directly by the high-pressure feed pump at a pressure level that is determined by the pressure valve via which the high-pressure fuel reservoir is fed. This pressure valve, which is embodied as a check valve, permits the high-pressure fuel reservoir to be supplied when the opening pressure of the pressure valve is exceeded; in this instance, in contrast, the pressure of the high-pressure reservoir itself can be controlled to a lower value through the pressure control valve. In this way, the work surface of the supply piston can be equal in size to the supply surface. This simplifies the supply device significantly; it can be embodied to include a piston that slides in a cylinder.

In accordance with the invention, the additional reservoir can be embodied either as a volumetric reservoir that includes, for example, the volumetric content of the connecting line between the high-pressure feed pump and the supply device, or as a reservoir that additionally communicates with this connecting line and has a wall that can move counter to a restoring force. This permits greater independence of the supplementary liquid to be metered from the length of the connection between the high-pressure feed pump and the supply device.

In accordance with the invention, the supply device is advantageously provided with a spring that acts on the supply piston, counter to the high fuel pressure, and is embodied as a prestressing spring. In this case, the supply piston can advantageously be prestressed to an intended prestressing stroke, corresponding to the quantity of supplementary liquid to be metered, at intervals between supplementary liquid metering phases. At the time of the necessary supply of the quantity of supplementary liquid, the work chamber bordering the work surface of the supply piston is purposefully relieved by means of the electrically controlled valve embodied as, for example, a magnet valve, and feeding is effected that is always performed uniformly according to the characteristic of the prestressing spring.

In a further advantageous embodiment, a single supply device is provided for supplying a plurality of fuel injection valves; the supply line of the supply device communicates, via lines that branch off from it, with one of the fuel injection valves at a time, an embodiment that entails little expense. In this instance, the pressure chamber of these injection valves is respectively coupled to the supply device via a check valve, so a very high pressure can only build up in the branch lines within the fuel injection valve.

The metering of supplementary liquid is improved and more precise if a distributor is advantageously disposed in the supply line of the supply device, which distributor is driven synchronously with respect to the rpm of the engine, and respectively actuates the fuel injection valve through which fuel injection next takes place. Here the supply device can supply a specific quantity of supplementary liquid per injection valve, while in the above-mentioned, simpler design, which is less costly to produce, the supply device must simultaneously supply a quantity of supplementary liquid for all of the injection valves in a single supply stroke and at the appropriate time. For the introduction of the necessary quantity of supplementary liquid per injection process, the fluid can also be supplied with a plurality of supply strokes of the supply piston. To increase the precision of the metering of the supplementary liquid, a travel transducer is advantageously provided at the supply piston, which emits a feedback signal to an electric control unit that serves to control the magnet valves, taking into consideration the operating parameters mentioned at the outset.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
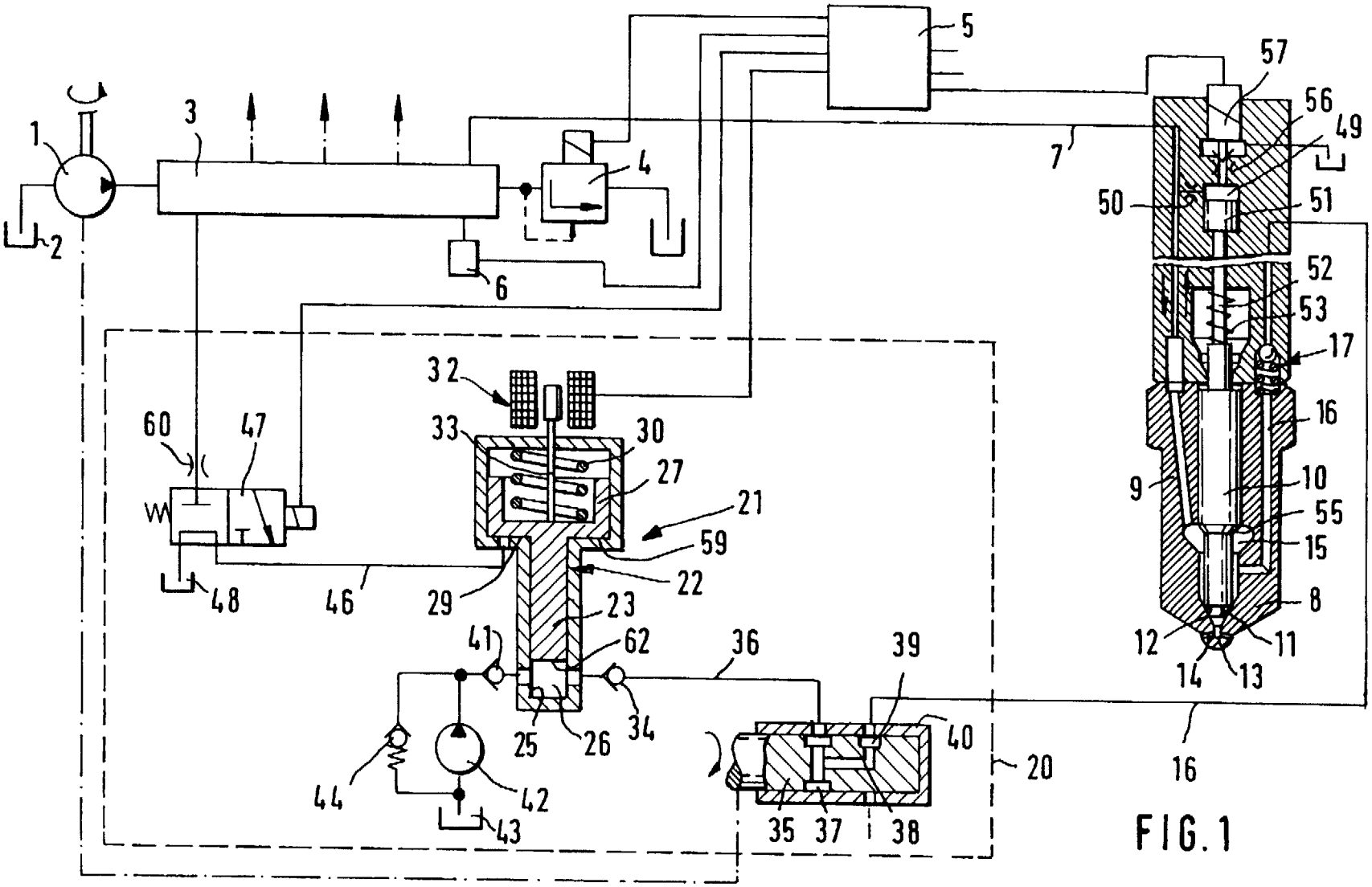
FIG. 1 shows a first exemplary embodiment of the invention, in which a supply device includes a stepped supply piston that can be made to communicate with the high-pressure reservoir via a 3/2-way magnet valve in order to be driven.

The injection device shown schematically in FIG. 1 serves to supply a plurality of cylinders of an internal combustion engine, particularly a spark-ignited internal combustion engine into whose cylinders both fuel and a supplementary liquid, particularly water, are injected to reduce the formation of harmful substances during combustion in combustion chambers of an internal combustion engine. For a fuel supply, the injection device has a high-pressure feed pump 1, which is preferably driven synchronously with the rpm of the engine and feeds fuel under high pressure from a fuel reservoir 2 to a high-pressure fuel reservoir 3. This arrangement forms a high-pressure fuel source. The fuel brought into the high-pressure reservoir 3 is maintained at a predetermined value by means of a pressure control valve 4; this valve can be regulated mechanically or via an electronic control unit 5 that receives a feedback signal from a pressure sensor 6 relating to the pressure in the high-pressure fuel reservoir, and thus sets the pressure at a specific value that can be a constant value, as well as a value dependent on the operating parameters of the engine.

The fuel brought to high pressure is supplied from the high-pressure reservoir 3 to an injection valve 8 via one pressure line 7 each. One injection valve is provided for each cylinder of the associated engine; all the valves are supplied from the high-pressure fuel source 1, 3.

The drawing shows the injection valve 8 in simplified form. The valve is a so-called "injector" having a valve body 9, in which a valve member 10 is guided in a guide bore in a known manner. The tip of the valve member, facing toward the combustion chamber, has a conical sealing face 11 that cooperates with a corresponding conical valve seat 12 of the valve body 8. In the shown closed position of the valve member, the member separates a blind bore 13, which is located on the side of the combustion chamber and from which injection openings 14 exit toward the combustion chamber, from a pressure chamber 15 in the valve body 9 that adjoins the other side. The pressure line 7 from the high-pressure reservoir 3 discharges into the valve body 9, and an additional line 16 also discharges in the pressure chamber 15; this line includes a check valve 17 that lies within the injection valve and opens in the direction of the pressure chamber 15. The additional line 16 serves to supply a supplementary liquid, which, in the present exemplary embodiment, is preferably water made available by a supplementary liquid pressure source 20. The source has a supply device 21 that comprises a supply piston 32 in the form of a stepped piston that has a part 23 that is smaller in diameter and defines a supply chamber 26 at the end face in a stepped cylinder 25. Together with a corresponding annular surface between its larger-diameter part and its smaller-diameter part, the annular surface of the larger-diameter part 27 of the stepped piston 22 defines a work chamber 29 that is disposed between the larger-diameter part of the stepped cylinder 25 and the smaller-diameter part. On the side remote from this work chamber 29, the larger-diameter part 27 of the stepped piston 25 is acted upon by a compression spring 30 in the supply direction. The stepped cylinder 25 is pressure-relieved on this side. The distance traversed by the stepped piston counter to the force of the compression spring 30 can be detected by a travel transducer 32, which can be embodied in a known manner as, for example, an inductive travel transducer having a part 33 that is coupled to the stepped piston.

Via a supply line 36, which contains a supply check valve 34 that opens in the supply direction, away from the supply chamber, the supply chamber 26 communicates with the input of a distributor 35 that rotates, synchronously with the engine, in a cylinder 40. The supply line 36 that contains the supply check valve 34 discharges into an annular groove 37 of the distributor 35, which is alternatingly connected in turn to respectively one of the additional lines 16, which lead to the injection valves 8, via a distributor conduit 38 and a distributor opening 39 when the distributor rotates. The distributor conduit and distributor opening can also be embodied as a longitudinal groove extending from the annular groove. The additional lines 16 branch off from the cylinder 40 that receives the distributor 35, and are distributed at the circumference of the cylinder, corresponding to the number of injection valves to be supplied and injection cycles of the valves.

Via a feed check valve 41 that opens into the supply chamber 26, the supply chamber 26 of the supply device further communicates with a pre-feed pump 42 that continuously pumps supplementary liquid from a supplementary liquid reservoir 43 into the supply chamber 26 as long as the pressure ratios at the feed-type check valve 41 permit. The supply pressure of the pre-feed pump 42 is set by way of a standard pressure control valve 44.

To actuate the supply piston 22, the work chamber 29 is acted upon by the pressure of the high-pressure reservoir. To this end, a connecting line 46 is provided, in which a 2/3-way valve is disposed in the form of an electrically controlled valve, here as a magnet valve 47. Depending on the position of the valve member of this valve, the work chamber 29 is connected either to the high-pressure reservoir 3 or a relief chamber 48. A throttle 60 is provided in the connecting line 46, so the work chamber 29 is filled evenly at a controlled filling rate. In the former case, the supply piston 22 is driven counter to the force of the spring 30 to execute a filling stroke. Depending on the duration of the opening state of the 2/3-way valve, the stepped piston 22 performs a larger or smaller filling stroke, during which the supply chamber 26 remains filled with supplementary liquid by way of the feed check valve 41, and the compression spring is prestressed. If the 2/3-way valve is subsequently brought into its other position, the pressure chamber 29 is relieved, and the supply piston 22 can perform its supply stroke under the effect of the prestressing force of the spring 30. Depending on the rotational position of the distributor 35, one of the injection valves is supplied with supplementary liquid that has been pre-stored in the pressure chamber 15, forcing the fuel previously located there toward the high-pressure reservoir 3. To this end it is necessary for the supply pressure of the supply device 21 to be higher than the fuel pressure available in the high-pressure reservoir 3. Through the use of the above-described stepped piston, a force intensification is possible for this purpose if the supply piston 22 is acted upon by the pressure in the high-pressure reservoir 3.

To control the injection, a control chamber 49 is provided in the injection valve; this chamber communicates continuously with the pressure line 7 via a throttle 50, and is defined by an end face of a piston 51. By means of the pressure in the control chamber 49, force is exerted on a tappet 52, which in turn acts on the valve member 10 in the closing direction. Also acting in the closing direction is a closing spring 53, but its force alone is insufficient to keep the valve member 10 in the closed position. The valve member is continuously acted upon by the pressure in the pressure chamber 15, in addition to the force of the closing spring 53; this pressure acts, in the opening direction of the valve-closing member, on a shoulder 55 on the valve member 10.

The control chamber 49 can additionally be relieved by a throttle 56 and an electrically controlled valve, here a magnet valve 57. When the valve 57 opens, the opening force exerted on the valve-closing member 10 from the pressure chamber 15 prevails, so the injection valve opens for its injection process. During this injection process, the quantity of water pre-stored in the pressure chamber 15 is introduced, together with the fuel flowing after the water from the high-pressure reservoir 3, into the combustion chamber, as long as the injection valve, controlled by the magnet valve 57, is in the opening position. To close the injection valve, the magnet valve 57 is closed again, so the pressure of the high-pressure reservoir 3 can be re-established in the control chamber 49. Consequently, the valve member assumes its closed position, and the injection process is ended. The magnet valve 57 is likewise controlled by way of the electric control unit 5 in the necessary synchronous cycle of the work sequences of the engine. The control of the necessary quantity of fuel to be injected is effected at the same time as this temporal control. The quantity of supplementary liquid entering the combustion chamber at the same time is controlled by the electric control unit, through the actuation of the 2/3-way magnet valve 47. This valve can supply the necessary quantity of supplementary liquid, which can be controlled precisely, to each of the provided injection valves consecutively. The high fuel pressure already present is advantageously available for driving the supply device 21, so no further pressure sources are necessary, and the task of injecting a supplementary liquid can be performed at little expense.

Figure 2:
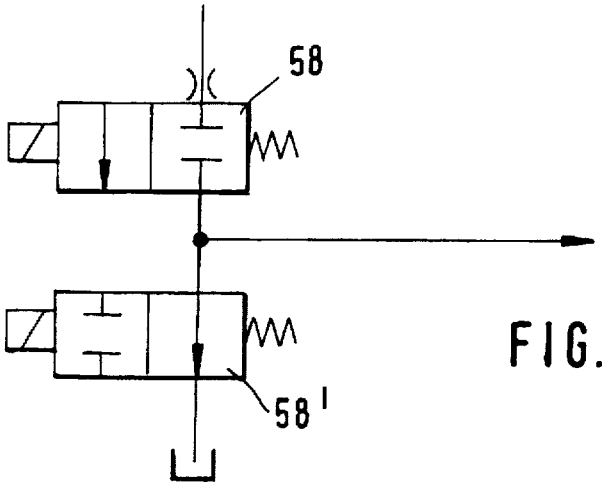
FIG. 2 shows a partial representation of the exemplary embodiment of FIG. 1, with two 2/2-way magnet valves.

In a modification of the above-described exemplary embodiment, the combination of two electrically controlled 2/2-way valves 58 and 58' can be used in place of the 2/3-way valve 47. These valves, which are shown in FIG. 2, are embodied as magnet valves. The one valve 58 is disposed between the high-pressure reservoir 3 and the connecting line 46 leading directly to the work chamber 29, while the other 2/2-way valve 58' is disposed between this connecting line 46 and a relief chamber. The valves are driven in push-pull fashion, so one valve is always open and the other is always closed. It is possible, however, to keep both valves closed to establish an equilibrium of the supply piston 22.

Figure 3:
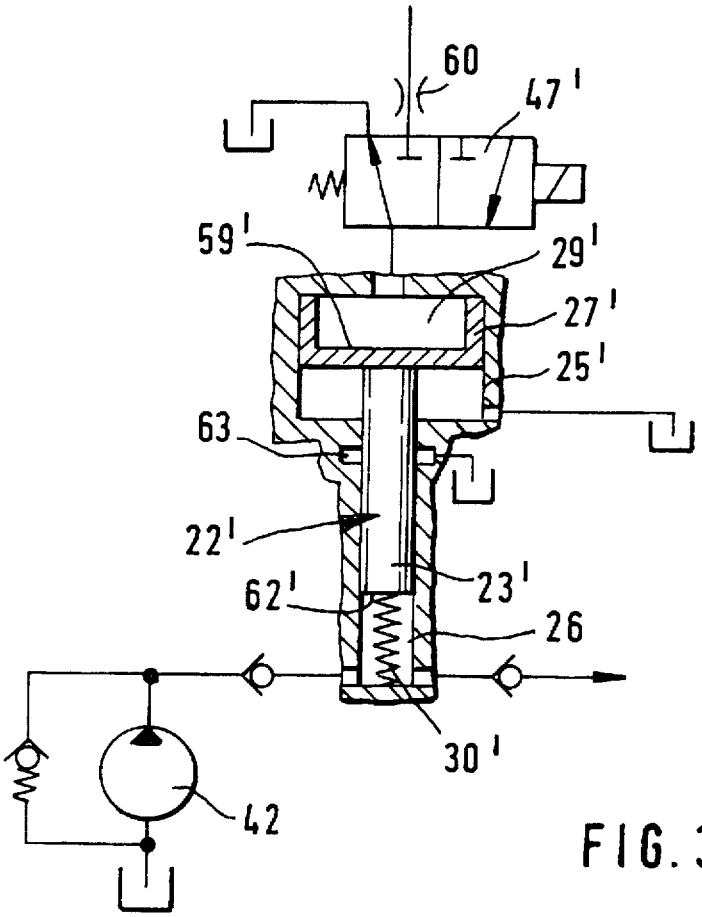
FIG. 3 shows an alternative drive principle for the supply piston of the supply device.

FIG. 3 shows a variation of the embodiment of the supply piston according to FIG. 1. While in the exemplary embodiment of FIG. 1, the annular surface of the larger-diameter part 27 of the supply piston 22 that demarcated the annular chamber or work chamber 29 defined there served as a work surface 59, in the exemplary embodiment according to FIG. 3, the entire cross-sectional area of the larger-diameter part 27' of the supply piston 22' is embodied as a work surface 59'. The work chamber 29' encompassed by this work surface 59' in the stepped cylinder 25' is again connected, via a valve 47' that corresponds to the 3/2-say valve 47, to either the high-pressure reservoir 3 or a relief chamber. In the process, the connection to the high-pressure reservoir is produced, as in the exemplary embodiment of FIG. 1, via a throttle 60 for uniform filling of the work chamber 29 or 29'. The annular chamber enclosed on the side of the larger-diameter part 27' of the supply piston 22', which is the side remote from the work chamber 29', is relieved toward a relief chamber, to which leaked fuel in particular can flow. A spring 30', which no longer serves the purpose of restoring the supply piston 22' for feeding, but in the execution of the suction stroke of the supply piston 22' when the work chamber 29 is relieved, is now active at the end face, that is, the supply surface 62', of the smaller-diameter part of the supply piston 22'. An annular groove 63 is further provided between the smaller-diameter part 23' of the supply piston 22' and the stepped cylinder 25' that guides this part. The annular groove serves to return quantities of leaked supplementary liquid to a reservoir. The supply chamber 26 then communicates with the feed pump 42 or the injection valves 8 in the same manner as in FIG. 1.

This embodiment, which can also be allocated an additional travel transducer, has the advantage of a larger available work surface 59' in relation to the supply surface 62', and therefore a greater pressure intensification can be attained, with the same structural size, in comparison to the exemplary embodiment of FIG. 1.

Figure 4:
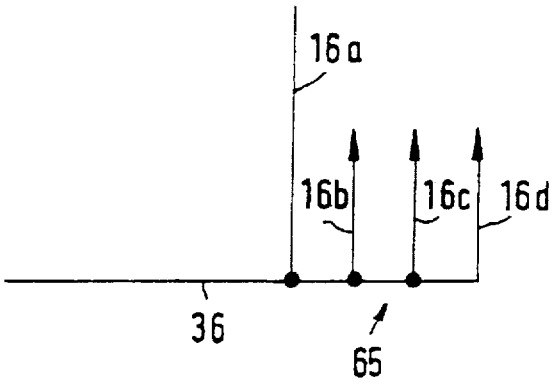
FIG. 4 shows a simplified variation of the exemplary embodiment of FIG. 1, in which a previously-provided distributor is replaced by line branches, with the supply piston feeding supplementary liquid synchronously with the work cycles of the engine.
Figure 5:
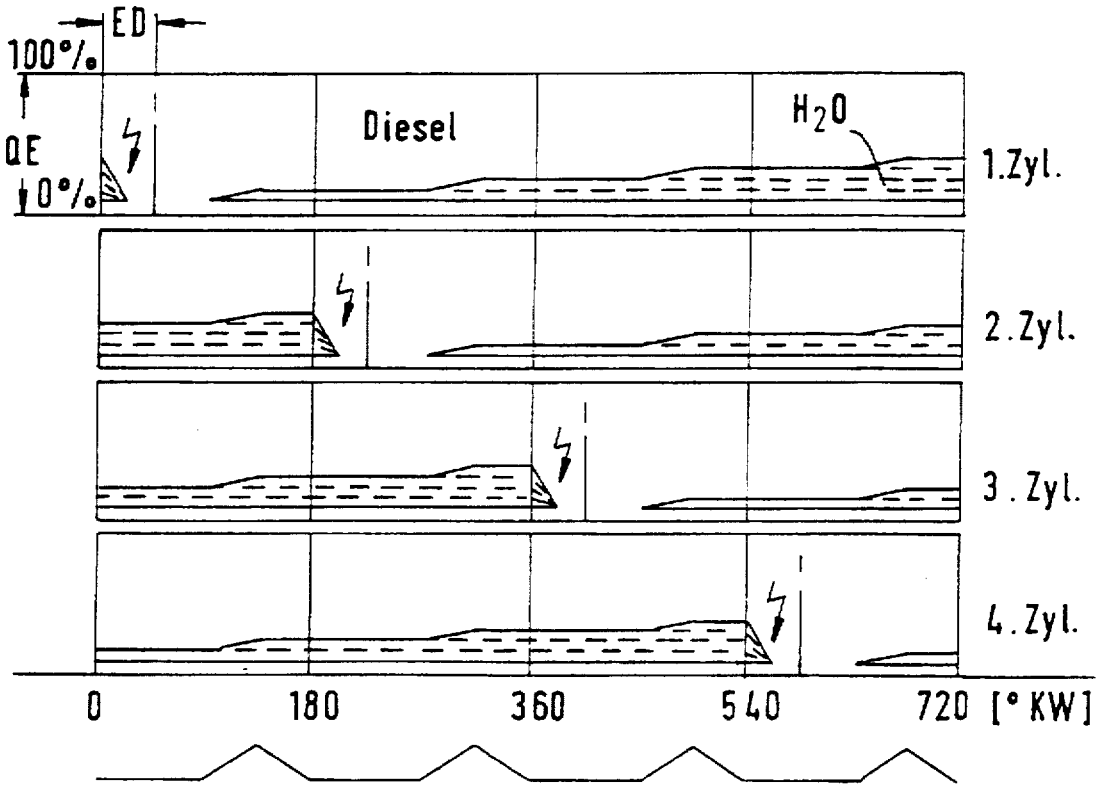
FIG. 5 shows a diagram of the exemplary embodiment of FIG. 4, showing the course over time of the pre-storage of supplementary liquid in the individual fuel injection valves.

Instead of having the distributor 35 in the exemplary embodiment according to FIG. 1, the embodiment of FIG. 4 is simplified by the provision of a branch circuit distributing center 65; the supply line 36 branches directly into the additional lines **16*a*, 16*b*, 16*c* and 16*d*, depending on the number of fuel injection valves to be supplied. As in the exemplary embodiment of FIG. 1, these additional lines 16*a* through 16*d* respectively lead into the pressure chamber 15 of the injection valves via a check valve 17. During each supply stroke of the supply piston 22 or 22', conveyance is effected simultaneously into all pressure chamber 15 of the associated injection valves 8. The conveyance phases of the supply piston 22** are timed such that the supplementary liquid is conveyed into the injection valves during the intervals between injections by the injection valves. To avoid having to convey the entire quantity of supplementary liquid that suffices for all injection valves for the respective process of injection of fuel and supplementary liquid with a single supply stroke, the supplementary liquid is conveyed in a plurality of supply strokes, as shown in the diagram in FIG. 5. In the process, the supplementary liquid is pre-stored sequentially in defined stages until a maximum quantity of supplementary liquid is attained immediately prior to the intended injection process, which is characterized by a zig-zagging arrow in the drawing. The feeding movements of the supply piston 22 are shown over the crankshaft angle below these partial diagrams.

Figure 6:
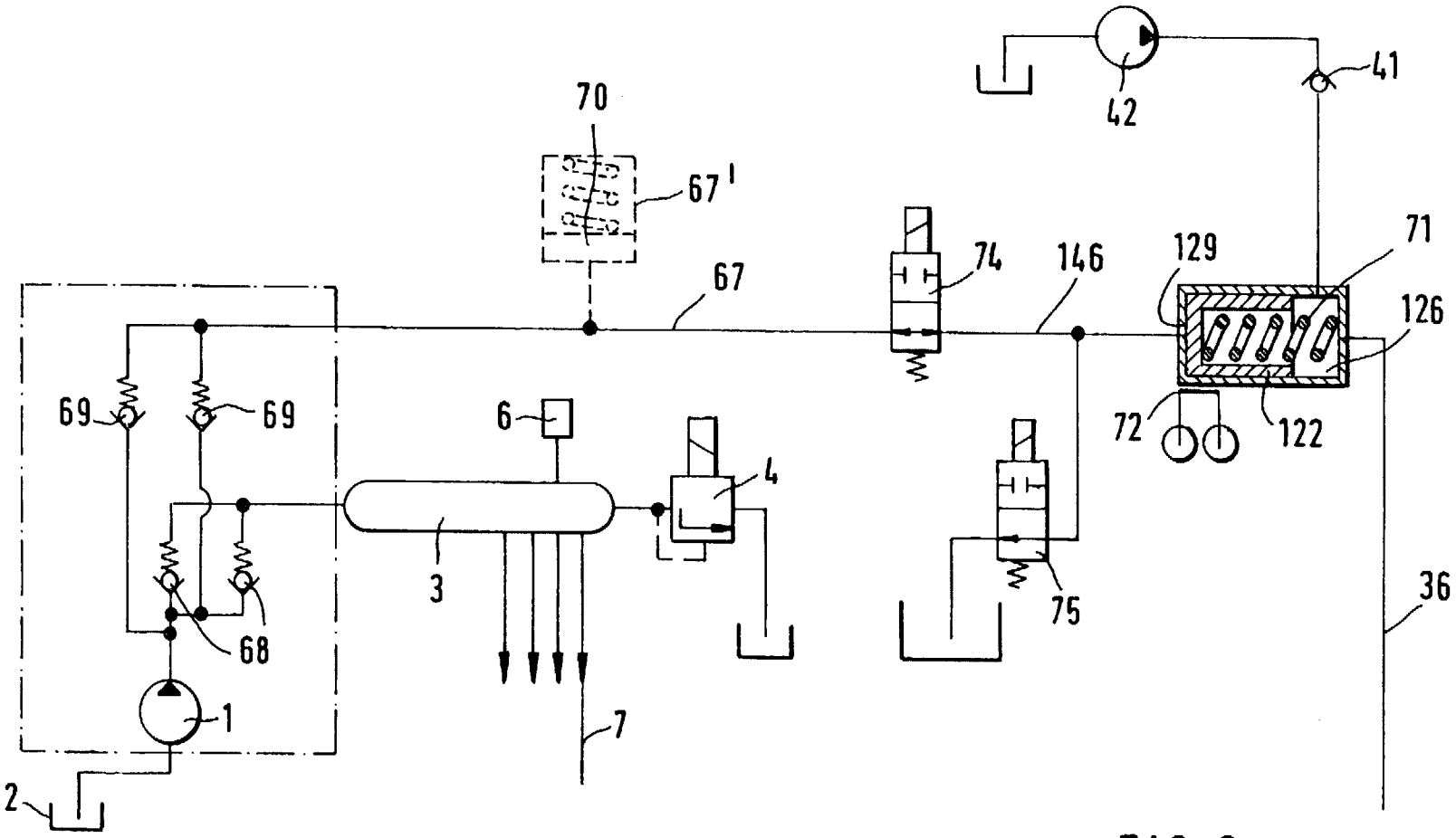
FIG. 6 shows a fifth exemplary embodiment of the invention, in which the supply piston of the supply device is supplied by an additional reservoir decoupled from the high-pressure feed pump by check-type pressure valves, with the reservoir pressure being determined by pressure valves that lead to the high-pressure reservoir.

In a further exemplary embodiment, which is shown in FIG. 6, the supply piston 122 is no longer driven directly by the high-pressure reservoir 3, but via an additional reservoir 67. In this embodiment, the pressure supply of the fuel injection valves with fuel to be injected is effected in the same manner as in the exemplary embodiment of FIG. 1. A high-pressure feed pump 1 is provided that feeds fuel at high pressure from the fuel reservoir 2 into the high-pressure reservoir 3, whose pressure is monitored via the pressure sensor 6 and is controlled with the aid of the pressure control valve 4. Pressure lines 7 lead to the respective fuel injection valve 8, which is constructed in the same manner as in the embodiment of FIG. 1, and is not shown in greater detail in FIG. 6. The supply of fuel conveyed by the high-pressure pump 1 is effected via one pressure-check valve or two valves 68, whose opening pressure is higher than the fuel pressure to be maintained in the high-pressure fuel reservoir 3. An additional reservoir 67 further communicates with the supply side of the high-pressure feed pump via check valves 69 that allow fuel into the additional reservoir 67 under a pressure that is limited by the opening pressure of the pressure-check valves 68. As shown first in FIG. 6, this additional reservoir 67 can be a line-type reservoir, which has an essentially fixed volume, or a so-called volumetric reservoir; however, a reservoir 67' that is defined by a movable wall 70, as shown in dashed lines in the drawing, can be provided for storing large quantities of pressure media.

Because of the pressure for driving, which is available in the additional reservoir 67 and is higher in comparison to the pressure in the high-pressure reservoir 3, it is possible to embody the supply piston 122 of this exemplary embodiment as a normal, non-stepped piston that is acted upon, for example, a restoring spring 71 in the direction of an initial position. Analogously to the exemplary embodiment of FIG. 1, the supply chamber 126 of this supply piston 122 is supplied with supplementary liquid by a pre-feed pump 42 and a feed check valve 41 in this initial position, which is shown in the drawing. The respective position of the supply piston 122 is monitored by a travel transducer 72, as in the exemplary embodiment of FIG. 1, and the detected travel signal is fed back to the electric control unit 5. To actuate the supply piston 122, a 2/2-way magnet valve 74, likewise a magnet valve in this case, is opened in the connecting line 146, between the intermediate reservoir 67 and the work chamber 129 of the supply piston 122, so fuel displaces the supply piston 122 under high-pressure during its supply stroke. To end this supply stroke, the 2/2-way magnet valve 74 is re-closed and, in its place, a second 2/2-way valve is opened, by way of which the pressure in the work-chamber 129 is relieved. This process is effected in the embodiment already described in conjunction with FIG. 2.

The supplementary liquid conveyed by the supply piston 122 is supplied either via a distributor 35 that is driven synchronously with the rpm of the engine, as in the exemplary embodiment of FIG. 1, or via a line distributor 65 in accordance with the exemplary embodiment of FIG. 4. The sequence of operation of the supply piston 122 is also set correspondingly. In this embodiment, higher operating costs for producing a stepped supply piston can be avoided with the use of simple pressure valves. In particular, a very economical solution is found in connection with a line distributor according to the exemplary embodiment of FIG. 4. An additional reservoir 67' having a movable wall can be realized with slightly increased costs.

In the exemplary embodiment of FIG. 4 that has a line distributor, but also in the embodiment of FIG. 1 that has a distributor 35, in the operation of the injection device, it can occur during the injection process following the pre-storage that the pressure drops in the pressure chamber 15 of the respective injection valve 8; consequently, a small quantity of supplementary liquid is then reaspirated from the additional line 16.

Figure 7:
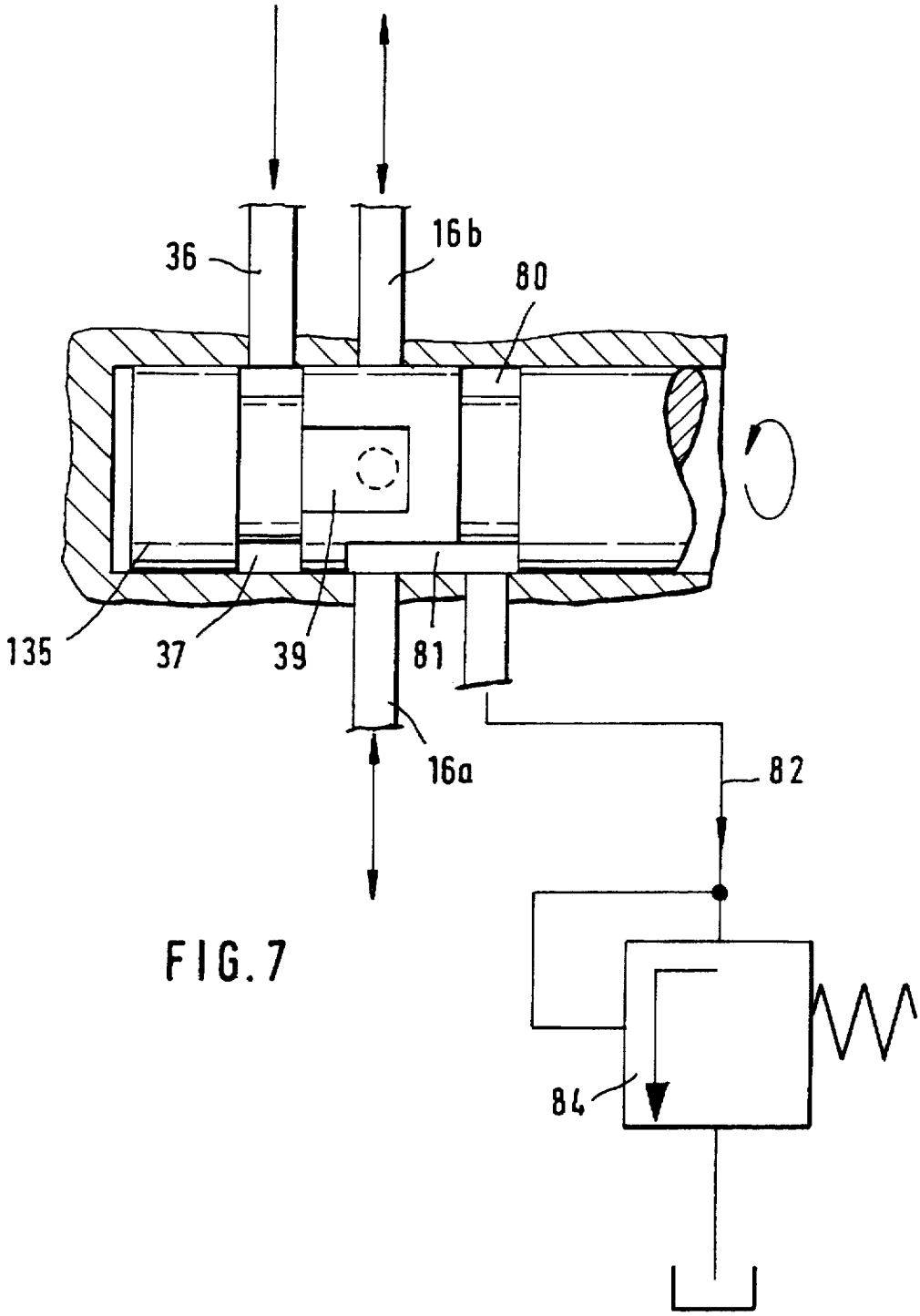
FIG. 7 shows a modification of the exemplary embodiment of FIG. 1, in which the supplementary liquid conveyed by the supply device is distributed by a distributor that connects the respective injection valve in alternation to the supply line of the supply device and a relief line.

To prevent this, the distributor 135 of FIG. 7 is provided with a second annular groove 80, which is disposed on the other side of the distributor opening 39 leading away from the first annular groove 37, and has a distributor groove 81 oriented toward the first annular groove. The distributor groove likewise cooperates with the additional lines 16 leading away from the cylinder 40, which come to communicate with the distributor groove 81 in the sequence of injection after their connection of the distributor opening 39 to the distributor groove 81 has been interrupted. The second annular groove 80 communicates continuously with a relief line 82, in which a pressure-limiting valve 84 is inserted for maintaining a constant, lowered pressure that is lower, with a safety margin, than the pressure established in the pressure chamber 15.

The foregoing relates to preferred exemplary embodiments the invention, it being understood that other variants and embodiments thereof are possible within the spirit and scope of the invention, the latter being defined by the appended claims.

What is claimed and desired to be secured: by Letters Patent of the United States is:

1. An injection device for the combined injection of fuel and a supplementary liquid into a combustion chamber of an internal combustion engine, the device comprising an injection valve (8), which has a pressure chamber (15) upstream of an injection opening (14), which pressure chamber is controlled by a valve member (10), said pressure chamber communicates with a high-pressure fuel source (1, 3) via a pressure line (7), and communicates via a check valve (17) and an additional line (16) with a metering device (20) for intermittent pre-storage of metered supplementary liquid in the pressure chamber (15) prior to the opening of the injection opening (14) by the valve member (10) for an injection of fuel and supplementary liquid into the combustion chamber of the engine, the injection device further having a supply device (21) that can be intermittently actuated, with the high fuel pressure of the high-pressure source (1, 3), by way of at least one electrically controlled valve (47, 74, 75), with the supply device being part of the metering device (20), the injection device further having an injection quantity control device for controlling the quantity of fuel to be injected that is supplied for injection from the high-pressure fuel source (1, 3), the injection quantity control device having a control valve in the form of an electrically controlled valve (57), a low pressure fuel supply and a high-pressure feed pump (1) are provided as the high-pressure fuel source, the pump supplying a high-pressure reservoir (3) in which a specific pressure is set and from which the fuel specified for the fuel injection is removed, and controlled by the control valve (57) associated with each injection valve (8).

2. An injection device as defined in claim 1, in which the supply device (21) has a supply piston (22) for supplementary liquid, which piston can be brought into a preferential position by a spring (30, 30') and defines a supply chamber (26) in a cylinder (25) that can be made to communicate via a fill-check valve (41) with a supplementary liquid supply (42), by way of which the supply chamber is filled with supplementary liquid during the intervals between pump feeding phases, and is connected to at least one injection valve (8) via a supply-check valve (34) that opens in the supply direction, via a supply line (36), and can be displaced, counter to the force of the spring (30, 30'), by the high fuel pressure supplied via the electrically controlled valve (47).

3. An injection device as defined in claim 2, in which the high fuel pressure for actuating the supply piston (22) is taken from the high-pressure reservoir (3), and a work surface (59, 59') that is exposed to the high pressure and is in operational connection with the supply piston (22) is larger than the supply surface (62) of the supply piston (22) bordering the supply chamber.

4. An injection device as defined in claim 2, in which the high fuel pressure for actuating the supply piston (122) is taken from an additional reservoir (67, 67') that communicates with the high-pressure supply pump (1) via a check valve (69) that opens in the direction of the additional reservoir, and a line to the high-pressure fuel reservoir (3) branches off from the high-pressure supply pump (1), upstream of the check valve (69), which line contains a pressure valve (68) as a supply valve, whose opening pressure is higher than the maximum pressure set by a pressure control valve (4) in the high-pressure fuel reservoir (3).

5. An injection device as defined in claim 4, in which the additional reservoir (67) is a volumetric reservoir.

6. An injection device as defined in claim 4, in which the additional reservoir (67') has a movable wall (70).

7. An injection device as defined in claim 3, in which the spring (30) that acts on the supply piston (22) counter to the high fuel pressure is embodied as a prestressing spring, and a work chamber (29) bordering the work surface (59) is relieved via the electrically controlled valve (47) for feeding supplementary liquid, and is re-exposed to the high fuel pressure (3) via the electrically controlled valve (47) for re-filling the supply chamber (26).

8. An injection device as defined in claim 3, in which the spring that acts on the supply piston (22), counter to the high fuel pressure, is embodied as a restoring spring (30'), and a work chamber (29') bordering the work surface (59') of the supply piston (22') communicates with the high pressure via the electrically controlled valve (47') for feeding the supplementary liquid, and is relieved again via the electrically controlled valve (47') for ending the conveyance of the supplementary liquid.

9. An injection valve as defined in claim 7, in which the electrically controlled valve (47, 47') is a 2/3-way valve.

10. An injection valve as defined in claim 8, in which the electrically controlled valve (47, 47') is a 2/3-way valve.

11. An injection device as defined in claim 7, in which two electrically controlled valves (58, 58') are provided for controlling the movement of the supply piston (22), with one valve serving to connect the work chamber (29) to the high-pressure fuel source (3, 67) and the other serving to relieve the work chamber (29).

12. An injection device as defined in claim 8, in which two electrically controlled valves (58, 58') are provided for controlling the movement of the supply piston (22), with one valve serving to connect the work chamber (29) to the high-pressure fuel source (3, 67) and the other serving to relieve the work chamber (29).

13. An injection device as defined in claim 3, in which the supply chamber (26, 126) communicates with one of the injection valves (8) via additional lines (16*a*, 16*b*, 16*c*, 16*d*) that branch off from the supply line (36), via a check valve (17) respectively associated with the injection valve (8).

14. An injection device as defined in claim 4, in which the supply chamber (26, 126) communicates with one of the injection valves (8) via additional lines (16*a*, 16*b*, 16*c*, 16*d*) that branch off from the supply line (36), via a check valve (17) respectively associated with the injection valve (8).

15. An injection device as defined in claim 3, in which the supply chamber communicates with one of the injection valves (8) via a distributor (35) disposed in the supply line (36) and driven synchronously with the rpm of the engine, via the check valve (17) respectively associated with the injection valve (8).

16. An injection device as defined in claim 4, in which the supply chamber communicates with one of the injection valves (8) via a distributor (35) disposed in the supply line (36) and driven synchronously.-with the rpm of the engine, via the check valve (17) respectively associated with the injection valve (8).

17. An injection device as defined in claim 12, in which the distributor (135) has a first distributor opening (39) that communicates continuously with the supply line (36), with the opening being connected consecutively to an additional line (16*a*, 16*b*, 16*c*, . . . ) leading to an injection valve (8) when the distributor (35) rotates, the distributor having a second distributor opening (81) that communicates continuously with a relief line (82) and communicates with the respective additional line (16*a*, 16*b*, 16*c*) following the connection of the first distributor opening (39) to the respective additional line.

18. An injection device as defined in claim 16, in which the distributor (135) has a first distributor opening (39) that communicates continuously with the supply line (36), with the opening being connected consecutively to an additional line (16*a*, 16*b*, 16*c*, . . . ) leading to an injection valve (8) when the distributor (35) rotates, the distributor having a second distributor opening (81) that communicates continuously with a relief line (82) and communicates with the respective additional line (16*a*, 16*b*, 16*c*) following the connection of the first distributor opening (39) to the respective additional line.

19. An injection device as defined in claim 13, in which a pressure-maintaining valve (84) is disposed in the relief line (82).

20. An injection device as defined in claim 1, in which a travel transducer (32, 72) is associated with the supply pistons (22, 122), via which travel transducer a control signal is transmitted to a control unit (5) for controlling the electrically controlled valve (47, 47') or the electrically controlled valves (58, 58', 74, 75).

* * * * *